US010294756B2

(12) United States Patent
Smith et al.

(10) Patent No.: US 10,294,756 B2
(45) Date of Patent: May 21, 2019

(54) ARTICLES AND METHODS FOR REDUCING HYDRATE ADHESION

(75) Inventors: J. David Smith, Cambridge, MA (US); Kripa K. Varanasi, Lexington, MA (US); Gareth H. McKinley, Acton, MA (US); Robert E. Cohen, Jamaica Plain, MA (US); Adam J. Meuler, Malden, MA (US); Harrison L. Bralower, Cambridge, MA (US)

(73) Assignee: MASSACHUSETTS INSTITUTE OF TECHNOLOGY, Cambridge, MA (US)

( * ) Notice: Subject to any disclaimer, the term of this patent is extended or adjusted under 35 U.S.C. 154(b) by 1429 days.

(21) Appl. No.: 13/218,095

(22) Filed: Aug. 25, 2011

(65) Prior Publication Data

US 2012/0160362 A1 Jun. 28, 2012

Related U.S. Application Data

(60) Provisional application No. 61/376,811, filed on Aug. 25, 2010.

(51) Int. Cl.

| | |
|---|---|
| ***B32B 1/08*** | (2006.01) |
| ***E21B 37/06*** | (2006.01) |
| *B32B 1/02* | (2006.01) |

(52) U.S. Cl.

CPC ..... *E21B 37/06* (2013.01)

(58) Field of Classification Search

CPC ..... B32B 1/08; Y10T 428/1334; E21B 37/06
USPC ..... 428/34.1, 34.2, 35.7, 35.9, 36.9
See application file for complete search history.

(56) References Cited

U.S. PATENT DOCUMENTS

| | | | | |
|---|---|---|---|---|
| 5,154,741 | A * | 10/1992 | da Costa Filho | 96/157 |
| 5,816,280 | A * | 10/1998 | Rojey et al. | 137/13 |
| 5,817,898 | A | 10/1998 | Delion et al. | |
| 5,900,516 | A | 5/1999 | Talley et al. | |
| 5,936,040 | A | 8/1999 | Costello et al. | |
| 6,028,234 | A | 2/2000 | Heinemann et al. | |
| 6,093,862 | A | 7/2000 | Sinquin et al. | |
| 6,297,208 | B1 | 10/2001 | Crist | |
| 6,329,490 | B1 * | 12/2001 | Yamashita et al. | 528/42 |
| 6,389,820 | B1 | 5/2002 | Rogers et al. | |
| 6,652,669 | B1 | 11/2003 | Reihs et al. | |
| 6,994,045 | B2 * | 2/2006 | Paszkowski | 114/67 R |

(Continued)

FOREIGN PATENT DOCUMENTS

| | | | |
|---|---|---|---|
| EP | 0230112 | A2 | 7/1987 |
| EP | 1892458 | A1 | 2/2008 |
| WO | WO-2006/132892 | A2 | 12/2006 |
| WO | WO-2011/163190 | A1 * | 12/2011 |

OTHER PUBLICATIONS

International Search Report for PCT/US2011/049187, dated Jan. 23, 2013, 4 pages.

(Continued)

*Primary Examiner* — Marc A Patterson
(74) *Attorney, Agent, or Firm* — Choate, Hall & Stewart LLP; William R. Haulbrook; Alexander D. Augst

(57) ABSTRACT

This invention relates generally to articles, devices, and methods for gas hydrate mitigation in deep-sea drilling applications. In certain embodiments, hydrate-phobic surfaces are provided that ensure passive enhancement of flow assurance and prevention of catastrophic failures in deep-sea oil and gas operations.

15 Claims, 9 Drawing Sheets

(56) References Cited

U.S. PATENT DOCUMENTS

| | | | | |
|---|---|---|---|---|
| 7,344,783 | B2 * | 3/2008 | Shea | 428/429 |
| 7,597,148 | B2 | 10/2009 | O'Malley et al. | |
| 7,632,466 | B2 | 12/2009 | Reihs et al. | |
| 7,687,593 | B2 * | 3/2010 | Yamahiro et al. | 528/31 |
| 7,985,451 | B2 * | 7/2011 | Luzinov et al. | 427/258 |
| 2003/0226806 | A1 | 12/2003 | Young et al. | |
| 2004/0206410 | A1 * | 10/2004 | Extrand | 138/39 |
| 2005/0009953 | A1 | 1/2005 | Shea | |
| 2005/0061221 | A1 | 3/2005 | Paszkowski | |
| 2007/0135602 | A1 | 6/2007 | Yamahiro et al. | |
| 2007/0224391 | A1 | 9/2007 | Krupenkin et al. | |
| 2009/0025508 | A1 | 1/2009 | Liao et al. | |
| 2009/0124520 | A1 | 5/2009 | Tohidi | |
| 2009/0185867 | A1 * | 7/2009 | Masters et al. | 405/216 |
| 2010/0180952 | A1 | 7/2010 | Verhelst et al. | |

OTHER PUBLICATIONS

Written Opinion for PCT/US2011/049187, dated Jan. 23, 2013, 7 pages.

International Preliminary Report on Patentability for PCT/US2011/049187, dated Mar. 7, 2013, 8 pages.

Chaudhuri et al., Dynamic Contact Angles on PTFE Surface by Aqueous Surfactants Slution in Absence and Presence of Electrolytes, Journal of Colloid and Interface Science, 337:555-562 (2009).

Good, Robert J., Contact angle, wetting and adhesion: a critical review, J. Adhesion Sci. Technol. vol. 6, No. 12, pp. 1269-1302 (1992).

Grace, J., Energy From Gas Hydrates: Assessing the Opportunities and Challenges for Canada, Council of Canadian Academies, Jul. 2008, 8 pages.

Sloan, Jr., E. Dendy, Fundamental Principles and Applications of Natural Gas Hdrates, Nature Publishing Group, 353-359 (2003), 7 pages.

Sum, Amadeu K. et al, Clathrate Hydrates: From Laboratory Science to Engineering Practice, American Chemical Society, Ind. Eng. Chem. Res., vol. 48, No. 16, pp. 7457-7465, Jul. 22, 2009, 9 pages.

Tropmann et al., Completely Superhydrophobic PDMS Surfaces for Microfluidics, Langmuir, ACS Publications (2012).

* cited by examiner

ARTICLES AND METHODS FOR REDUCING HYDRATE ADHESION

CROSS-REFERENCE TO RELATED APPLICATION

This application claims priority to and the benefit of, and incorporates herein by reference in its entirety, U.S. Provisional Patent Application No. 61/376,811, which was filed on Aug. 25, 2010.

FIELD OF THE INVENTION

This invention relates generally to preventing the formation of hydrates in oil and gas pipelines. More particularly, in certain embodiments, the invention relates to articles and methods for reducing the adhesive strength between a hydrate and the interior surface of a deep sea pipeline or portions thereof.

BACKGROUND OF THE INVENTION

The most recent world energy outlook predicts that energy demand in 2035 will be 36% higher than in 2008. The oil and gas industry is looking at ultra deep-sea exploration as a next frontier for meeting these increasing global energy needs. However, many challenges need to be overcome before drilling and production at greater depths becomes economical. One pressing challenge is the formation of natural gas hydrates in oil and gas pipelines.

Hydrates are crystalline structures consisting of a lattice of cages of water molecules that entrap hydrocarbon molecules at elevated pressures and low temperatures. Hydrates can plug oil lines, forcing operations to stop until they are removed, and in some extreme events, can pose safety issues by forming a projectile within the line if subjected to large differential pressures. Recently, hydrates were a key reason for the failure of the containment box approach to oil recovery after the 2010 Gulf spill as they clogged the opening of the box near the sea floor and prevented oil from being siphoned to boats on the surface.

Current methods for hydrate mitigation focus on using chemicals to shift the equilibrium hydrate formation curve to higher pressures and lower temperatures, using kinetic inhibitors to slow the growth of hydrates, and insulating or heating the pipeline walls. The costs associated with these methods and with lost oil and gas production due to hydrate plugging can run into billions of dollars (more than $200 M USD is spent annually on hydrate inhibiting chemicals alone). Furthermore, these currently employed methods are energy intensive and environmentally unfriendly, and alternative approaches to reduce hydrate adhesion are of great interest.

There is a need for articles and methods that prevent the formation and accumulation of hydrates in oil and gas pipelines.

SUMMARY OF THE INVENTION

The articles, devices, and methods presented herein provide effective methods of gas hydrate mitigation in deep-sea drilling applications. In certain embodiments, hydrate-phobic surfaces are provided that ensure passive enhancement of flow assurance and prevention of catastrophic failures in deep-sea oil and gas operations.

In one aspect, the invention relates to an article for use in a deep sea oil and/or gas recovery operation, the article comprising a surface having receding contact angle of water, $\theta_{rec}$, of no less than 70°. In certain embodiments, the article is an underwater pipeline. In certain embodiments, the surface comprises a fluoropolymer, for example, a silsesquioxane such as fluorodecyl polyhedral oligomeric silsesquioxane. In certain embodiments, the fluoropolymer is tetrafluoroethylene (ETFE), fluorinated ethylene-propylene copolymer (FEP), polyvinylidene fluoride (PVDF), perfluoroalkoxy-tetrafluoroethylene copolymer (PFA), polytetrafluoroethylene (PTFE), tetrafluoroethylene, perfluoromethylvinylether copolymer (MFA), ethylene-chlorotrifluoroethylene copolymer (ECTFE), ethylene-tetrafluoroethylene copolymer (ETFE), perfluoropolyether, or Tecnoflon.

In preferred embodiments, the surface has receding contact angle of water, $\theta_{rec}$, of no less than 90°. In further preferred embodiments, the surface has receding contact angle of water, $\theta_{rec}$, of no less than 100°, or no less than 110°.

In another aspect, the invention relates to an article for use in a deep sea oil and/or gas recovery operation, the article having a surface comprising fluorodecyl polyhedral oligomeric silsesquioxane.

In certain embodiments, the surface is a coating. In certain embodiments, the surface is a hydrate-phobic surface that inhibits hydrate adhesion thereupon. The hydrate-phobic surface may be advantageously located on an interior wall of a pipeline extending a distance from a valve in a direction of flow through the pipeline. For example, the hydrate-phobic surface may extend at least three meters from a valve in the direction of flow. The valve may be located at a Christmas tree of an offshore system.

In certain embodiments, the hydrate-phobic surface is located on an interior wall of a pipeline: (i) extending a first distance along and/or beyond a restriction in a direction of flow through the pipeline; (ii) extending along a fuel gas line in a direction of flow through the pipeline; (iii) extending along an instrument gas line in a direction of flow through the pipeline; (iv) extending a second distance along and/or beyond a valve within a fuel gas line in a direction of flow; (v) a third distance along and/or beyond a valve within an instrument gas line in a direction of flow; (vi) extending a fourth distance along and/or beyond a location of flow-line water accumulation in a direction of flow through the pipeline; (vii) extending a fifth distance along and/or beyond a flow-line low spot in a direction of flow through the pipeline; (viii) extending a sixth distance along and/or beyond a riser in a direction of flow through the pipeline; (ix) extending a seventh distance along and/or beyond a bend in the pipeline in a direction of flow through the pipeline; and/or (x) extending an eighth distance along and/or beyond a change in topography of ocean flow traversed by the pipeline. In certain embodiments, one or more of the first through eighth distance is at least three meters. In certain embodiments, one or more of the first through eighth distances is at least five meters.

In certain embodiments, the hydrate-phobic surface is located on or about a manifold of an offshore system. In certain embodiments, the hydrate-phobic surface is located on or about a sensor embedded in a pipeline of an offshore system.

In another aspect, the invention relates to an article for use in a deep sea oil and/or gas recovery operation, the article comprising a surface having a lattice parameter within a range from 2 Å to 2.24 Å, from 3 Å to 3.36 Å, from 4 Å to 4.48 Å, or from 6 Å to 6.72 Å, thereby promoting a lattice mismatch with a clathrate hydrate layer growing thereupon and inhibiting adhesion of the clathrate hydrate to the surface. In certain embodiments, the article is an underwater pipeline.

In certain embodiments, the surface has a lattice parameter within a range from 2 Å to 2.24 Å and comprises a member selected from the group consisting of beryllium and $Br_2Ni$.

In certain embodiments, the surface has a lattice parameter within a range from 3 Å to 3.36 Å and comprises a member selected from the group consisting of Cronstedtite, Silicon carbide (SiC), Iowaite, Brucite, $Fe(OH)_2$ ("white-rust"), Zaccagnaite, Moissanite (SiC), $CaIrO_3$, Dyscrasite, Zincite, Potarite, Tungsten, Pyrochroite, $Co(OD)_2$, $CaPtO_3$, B2Mo, Palladinite, Scandium, Lithium, $Ni_7S_6$, Molybdenite, Theophrastite, $Ag_{0.6}NbS_2$, cesium, silicon, $TaS_2$, $CoH_2O_2$, Koenenite, Hafnium, Magnesium, Scandium, Zirconium, Molybdenum, Nobium, Tantalum, titanium, vanadium, phosphorus, manganese-delta, AlN, GaN, NbN, TaN, TiS, VP, VS, MoB, WB, $Ti_2CS$, TaP, $Li_2O_2$, Amakinite, Antimony, $CuO_2Rh$, $Ti_3SiC_2$, $CaFe_3O_5$, $CaFe_4O_6$, $CaFe_5O_7$, $LiFeSnO_4$, $Li_{0.7}Fe_{0.375}Sn_{0.54}O_2$, Tungstenite, Jamborite (NiOH), N, $Nb_2$, Theophrastite (NiO), and Montroseite ($FeVOHO_2$).

In certain embodiments, the surface has a lattice parameter within a range from 4 Å to 4.48 Å and comprises a member selected from the group consisting of Periclase (MgO), Heazlewoodite (NiS), Stishovite (SiO), Stibarsen, vulcanite, Magnesite, Diaspore, Magnesiowustite (MgFeO), $SiO_2$, $GeO_2$, and FeB.

In certain embodiments, the surface has a lattice parameter within a range from 6 Å to 6.72 Å.

In certain preferred embodiments, the surface has a lattice parameter within a range from 2 Å to 2.12 Å, from 3 Å to 3.18 Å, from 4 Å to 4.24 Å, or from 6 Å to 6.36 Å.

In another aspect, the invention relates to an article for use in a deep sea oil and/or gas recovery operation, the article comprising a surface having a lattice mismatch E greater than zero and ≤0.15, wherein $\varepsilon=(n*a_s-a_h)/a_h$, where $a_s$ is substrate (surface) lattice parameter, $a_h$ is hydrate lattice parameter, and n is a multiple of the lattice parameter of the substrate closest to that of the hydrate. In certain preferred embodiments, $0<\varepsilon\leq 0.05$. In still more preferred embodiments, $0<\varepsilon\leq 0.005$.

In certain embodiments, the surface comprises a member selected from the group consisting of beryllium, $Br_2Ni$, Cronstedtite, Silicon carbide (SiC), Iowaite, Brucite, $Fe(OH)_2$ ("white-rust"), Zaccagnaite, Moissanite (SiC), $CaIrO_3$, Dyscrasite, Zincite, Potarite, Tungsten, Pyrochroite, $Co(OD)_2$, $CaPtO_3$, B2Mo, Palladinite, Scandium, Lithium, $Ni_7S_6$, Molybdenite, Theophrastite, $Ag_{0.6}NbS_2$, cesium, silicon, $TaS_2$, $CoH_2O_2$, Koenenite, Hafnium, Magnesium, Scandium, Zirconium, Molybdenum, Nobium, Tantalum, titanium, vanadium, phosphorus, manganese-delta, AlN, GaN, NbN, TaN, TiS, VP, VS, MoB, WB, $Ti_2CS$, TaP, $Li_2O_2$, Amakinite, Antimony, $CuO_2Rh$, $Ti_3SiC_2$, $CaFe_3O_5$, $CaFe_4O_6$, $CaFe_5O_7$, $LiFeSnO_4$, $Li_{0.7}Fe_{0.375}Sn_{0.54}O_2$, Tungstenite, Jamborite (NiOH), N $Nb_2$, Theophrastite (NiO), Montroseite ($FeVOHO_2$), Periclase (MgO), Heazlewoodite (NiS), Stishovite (SiO), Stibarsen, vulcanite, Magnesite, Diaspore, Magnesiowustite (MgFeO), $SiO_2$, $GeO_2$, FeB, Clausthalite, Altaite, Gudmundite, Celestine, Hafnon, Wadeite, $Fe_2C_9O_9$, Xifengite, Cubanite, Galena, Jagowerite, Tolovkite, Qandilite, Florenskyite, Marshite, $La_2O_3$, $Ce_2O_3$, $Pr_2O_3$, $ZrO_2$, rare earth stabilized zirconia, TiN, and CrN.

In certain preferred embodiments, one or more of the following holds: (i) $0<\varepsilon\leq 0.005$, (ii) $a_s$ is from 4 Å to 4.02 Å, and/or (iii) the surface comprises a member selected from the group consisting of Krupkaite, Periclase (MgO), Paarite, Griceite, NdOBr, Moncheite ($KMg_{0.5}Cu_{0.5}F_3$), $ZrO_2$, Cuprostibite, Moncheite, NdOCl, PuOCl, $Mn_2PrSi_2$, Litharge, BiOI, AgI, and $Ba_{0.156}Bi_{0.844}O_{1.422}$.

In another aspect, the invention relates to a deep sea oil and/or gas recovery operation, the article having a surface comprising discrete nucleation sites thereupon, thereby promoting preferred hydrate nucleation at the discrete nucleation sites, a resulting defective interface at the surface, and reduced hydrate adhesion upon the surface. In certain embodiments, the surface has heterogeneous surface chemistry. For example, the surface may be patterned with discrete hydrophobic regions and discrete hydrophilic regions, with the hydrate preferentially nucleating and/or growing on either the hydrophobic regions or the hydrophilic regions. In certain embodiments, the surface is textured. In certain embodiments, the surface comprises micro-scale and/or nano-scale particles deposited thereupon (e.g., particles with average diameter less than about 50 nm, less than about 1000, or less than about 100 micrometers). In certain embodiments, the surface comprises sintered silica and/or porous anodized aluminum. In certain embodiments, the surface comprises fluorosilane.

In certain embodiments, the surface comprises micro-scale and/or nano-scale posts (e.g., posts having width less than about 100 micrometers). For example, the surface may comprise silicon posts, e.g., which have hydrophobic surfaces. In certain embodiments, the posts have walls that are hydrophobic and tops that are hydrophilic, thereby promoting preferred hydrate nucleation at the tops and resulting in air pockets between posts.

In another aspect, the invention relates to an article for use in a deep sea oil and/or gas recovery operation, the article comprising a surface having a surface energy with negative Lewis acid parameter.

In certain embodiments of any of the above aspects of the invention, the surface is a coating. In certain embodiments, the surface is a hydrate-phobic surface that inhibits hydrate adhesion thereupon. In certain embodiments, the hydrate-phobic surface is located on an interior wall of a pipeline extending a distance from a valve in a direction of flow through the pipeline. In certain embodiments, the hydrate-phobic surface extends at least three meters from a valve in the direction of flow. In certain embodiments, the valve is located at a Christmas tree of an offshore system.

In certain embodiments, the hydrate-phobic surface is located on an interior wall of a pipeline: (i) extending a first distance along and/or beyond a restriction in a direction of flow through the pipeline; (ii) extending along a fuel gas line in a direction of flow through the pipeline; (iii) extending along an instrument gas line in a direction of flow through the pipeline; (iv) extending a second distance along and/or beyond a valve within a fuel gas line in a direction of flow; (v) a third distance along and/or beyond a valve within an instrument gas line in a direction of flow; (vi) extending a fourth distance along and/or beyond a location of flow-line water accumulation in a direction of flow through the pipeline; (vii) extending a fifth distance along and/or beyond a flow-line low spot in a direction of flow through the pipeline; (viii) extending a sixth distance along and/or beyond a riser in a direction of flow through the pipeline; (ix) extending a seventh distance along and/or beyond a bend in the pipeline in a direction of flow through the pipeline; and/or (x) extending an eighth distance along and/or beyond a change in topography of ocean flow traversed by the pipeline. In certain embodiments, one or more of the first through eighth distance is at least three meters. In certain embodiments, one or more of the first through eighth distance is at least five meters.

In certain embodiments, the hydrate-phobic surface is located on or about a manifold of an offshore system. In certain embodiments, the hydrate-phobic surface is located on or about a sensor embedded in a pipeline of an offshore system.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

While the invention is particularly shown and described herein with reference to specific examples and specific embodiments, it should be understood by those skilled in the art that various changes in form and detail may be made therein without departing from the spirit and scope of the invention.

DETAILED DESCRIPTION

Figure 1:
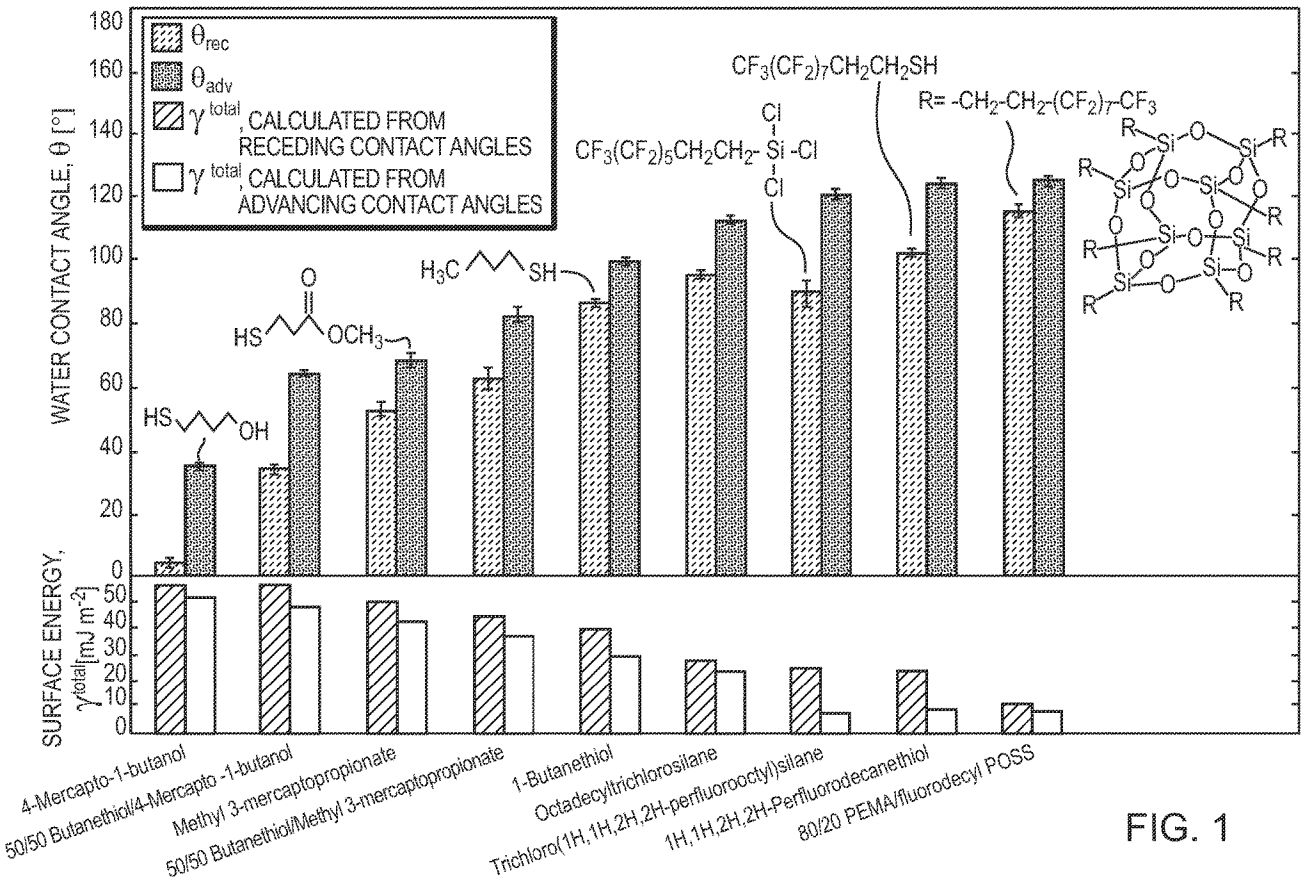
FIG. 1 includes a bar graph of advancing and receding contact angle measurements of DI water on various test substrates, and a bar graph of surface energies of each of the test substrates, according to an illustrative embodiment of the invention.

It is contemplated that compositions, mixtures, systems, devices, methods, and processes of the claimed invention encompass variations and adaptations developed using information from the embodiments described herein. Adaptation and/or modification of the compositions, mixtures, systems, devices, methods, and processes described herein may be performed by those of ordinary skill in the relevant art.

Throughout the description, where articles, devices and systems are described as having, including, or comprising specific components, or where processes and methods are described as having, including, or comprising specific steps, it is contemplated that, additionally, there are articles, devices, and systems of the present invention that consist essentially of, or consist of, the recited components, and that there are processes and methods according to the present invention that consist essentially of, or consist of, the recited processing steps.

Similarly, where articles, devices, mixtures, and compositions are described as having, including, or comprising specific compounds and/or materials, it is contemplated that, additionally, there are articles, devices, mixtures, and compositions of the present invention that consist essentially of, or consist of, the recited compounds and/or materials.

It should be understood that the order of steps or order for performing certain actions is immaterial so long as the invention remains operable. Moreover, two or more steps or actions may be conducted simultaneously.

The mention herein of any publication, for example, in the Background section, is not an admission that the publication serves as prior art with respect to any of the claims presented herein. The Background section is presented for purposes of clarity and is not meant as a description of prior art with respect to any claim.

In certain embodiments, the materials and methods described herein prevent hydrate plug formation in oil and gas pipelines by reducing hydrate adhesion strength to surfaces using functionalized coatings. Tools are provided for the design of low hydrate adhesion surfaces, i.e., "hydrate-phobic surfaces." In one embodiment, these tools provide a pathway to develop hydrate-phobic coatings for enhanced flow assurance. With reduced hydrate adhesion forces, hydrates (e.g., clathrate hydrates) that form on pipeline walls and other pipeline components are more easily detached from the walls by hydrodynamic forces within the pipeline.

In one embodiment, the adhesion strength of a hydrate to a solid surface is reduced by lowering the surface energy of the surface. As described further herein, the adhesion strength may be quantified or predicted in terms of the work of adhesion of a probe fluid, such as water, that is in turn characterized by a receding contact angle of the probe fluid (e.g., water) on the surface. For example, surfaces with high receding contact angles of water and other probe fluids may ensure low hydrate adhesion. In another embodiment, acid-base and van der Waals interactions, described above, are tailored for lowering hydrate adhesion.

In certain embodiments, hydrate adhesion is reduced by adjusting the wettability and/or surface energy of the adjacent substrate to produce a hydrate phobic surface. With this approach, the adhesion strength between a hydrate and the surface may be reduced by more than a factor of four, compared with the hydrate on bare steel. This reduction may be achievable on surfaces characterized by low Lewis acid, Lewis base, and van der Waals interactions, such that the work of adhesion is minimized.

In certain embodiments, an article is provided for use in a deep sea oil and/or gas recovery operation. The article includes a hydrate-phobic surface or coating that provides a reduced adhesion strength with a hydrate. In one embodiment, a receding contact angle, $\theta_{rec}$, between a probe fluid and the surface is greater than 70°, greater than 80°, greater than 90°, greater than 100°, or greater than 110°. The probe fluid may be water and/or a hydrate. In one embodiment, the probe fluid is a liquid that has surface energy parameters that are substantially similar to (e.g., within 20% of, within 10% of, or within 5% of) the surface energy parameters for a hydrate of interest (e.g., methane hydrate). The surface energy parameters include Lifshitz van der Waals, Lewis acid, and/or Lewis base parameters. In another embodiment, the surface or coating includes a fluoropolymer, silsesquioxane, fluorodecyl polyhedral oligomeric silsesquioxane, fluorinated ethylene-propylene, and/or perfluoropolyether. The article may be an underwater pipeline.

In another embodiment, hydrate adhesion strength is correlated with the normalized practical work of adhesion of a suitable probe fluid with similar surface energy properties to those of the hydrate. The probe fluid serves as a simple and valuable tool for predicting hydrate adhesion strength and rapidly screening surface treatments or coatings for hydrate-phobicity. For example, in certain embodiments, a probe fluid is identified to predict the adhesion strengths of gas hydrates (e.g., methane hydrate) to various materials. The probe fluid may be used because a liquid with identical chemistry to a gas hydrate may be unstable, as the solubility of a hydrate-stabilizing gas in liquid water may be much lower than its concentration in the hydrate phase. Thus, the surface energies of gas hydrates, such as methane hydrate, may be measured using van Oss-Chaudhury-Good (vOCG) analysis and a liquid solution designed with commensurate surface energy properties (characterized using a "reverse vOCG" analysis). This solution can then serve as a probe fluid to predict the adhesion strengths of gas hydrates to various materials, providing a much simpler alternative to high pressure gas hydrate adhesion testing. This approach can therefore lead to rapid screening of potential hydrate-phobic surfaces, such as those with specific chemistry chosen to minimize polar and van der Waals interactions governing the work of adhesion.

For example, in certain embodiments, contact angles may be measured for a probe fluid having surface energies that are similar to those of a hydrate of interest (e.g., methane hydrate) and various substrates. The contact angles may be used to calculate the practical work of adhesion, which has been shown to be correlated to adhesion strength. By measuring contact angles and calculating the practical work of adhesion for the probe fluid on various substrates of interest, substrates that produce low hydrate adhesion strengths may be readily identified. In one embodiment, simple measurements of receding contact angles of the probe fluid on substrates are a tool for the design or identification of hydrate-phobic surfaces.

In another embodiment, further reductions in hydrate adhesion are achieved by minimizing polar and nonpolar parameters of surface energy. In addition, hydrate adhesion may be further reduced by tailoring nano- and micro-scale surface morphology and chemistry to prevent penetration of the hydrate into the texture such that the hydrate rests atop the texture features to reduce contact at the hydrate-substrate interface. Other approaches, such as designing hybrid low/high surface energy morphologies that can spatially control nucleation (e.g. promote nucleation atop surface features) could be used to reduce hydrate adhesion under conditions favorable to desublimation or condensation.

In one embodiment, the probe fluid approach to predicting adhesion strength is extended to other materials. For example, the practical work of adhesion of a material in its liquid state to a substrate may be used to estimate the adhesion strength of the same material in its solid state to a substrate. This approach to predicting adhesion strength and methods of controlling adhesion strength may benefit many industrial applications such as de-icing, welding, composite materials, thin films and coatings, and salt scaling.

There are many factors that contribute to adhesion between two solids. The most significant of these are van der Waals forces, hydrogen bonding, electrostatic effects, and the surface morphology, which affects the total contact area over which the above effects act, and the amount of physical interlocking between the surfaces. Assuming electrostatic effects are negligible, the interaction of these bodies with each other will be due to van der Waals forces and hydrogen bonding (a Lewis acid/Lewis base interaction, which is especially important when dealing with polar materials such as water, ice, or hydrates) and surface texture.

As discussed below, a series of experiments were performed to measure contact angles, surface energies, and the strength of adhesive bonds between a hydrate and various materials. For example, the adhesion strength of Tetrahydrofuran (THF) hydrate was measured on surfaces having a range of wettabilities and energetic characteristics. The results of these adhesion tests indicate that adhesion strength ranged from 422±69 kPa on steel, which has a measured advancing surface energy of 36 mJ $m^{-2}$, to 90±16 kPa on steel coated with an 80/20 PEMA/fluorodecyl POSS blend, which has a measured advancing surface energy of 9 mJ $m^{-2}$. This four-fold reduction in adhesion strength demonstrates the importance of surface chemistry to adhesion. However, to design surfaces for reduced adhesion, the key surface properties that affect adhesion must be determined. In one embodiment, adhesion strength is correlated with the work of adhesion.

The work of adhesion between two smooth bodies is known to depend strongly on van der Waals (apolar), electron acceptor (Lewis acid), and electron donor (Lewis base) interactions. The latter interactions are generally alluded to as polar interactions and arise primarily due to hydrogen bonding, and are therefore especially important when considering polar materials such as water, ice, or hydrates. The sum of these interactions can be characterized by the thermodynamic work of adhesion, $W^a$, which is a function of the Lifshitz van der Waals, Lewis acid, and Lewis base parameters of surface energy of the adhering materials, denoted by $\gamma^{LW}$, $\gamma^+$, and $\gamma^-$ respectively. The work of adhesion of a material A to a material B is given by $$W_{AB}^{a}=2(\sqrt{\gamma_A^{LW}\gamma_B^{LW}}+\sqrt{\gamma_A^{+}\gamma_B^{-}}+\sqrt{\gamma_A^{-}\gamma_B^{+}})$$

where the subscripts A and B denote the two adhering materials. Note that the work of adhesion of material A to itself is simply the work of cohesion of material A, $W_A^c$. Then by reducing the right side of Equation 1, with both subscripts denoting material A, we obtain, $$W_A^c=2(\gamma_A^{LW}+2\sqrt{\gamma_A^{+}\gamma_A^{-}})=2\gamma_A^{total} \quad (1)$$

where $\gamma_A^{total}$, is the total surface energy of material A in equilibrium with its vapor. If one of the materials in Equation 1 is a liquid that exhibits a non-zero contact angle, $\theta_{AB}$, then the work of adhesion is also given by the Young-Dupré equation:

$$W_{AB}^{a}=\gamma_A^{total}(1+\cos\theta_{AB}) \quad (3)$$

If $\theta_{AB}=0$ then A may spread on B and $W_{AB}^{a}>W_{AA}^{c}$. In this fully wetted regime, $W_{AB}^{a}\geq\gamma_A^{total}(1+\cos\theta_{AB})=2\gamma_A^{total}=W_{AA}^{c}$. Thus Equation 3 cannot be used to calculate the work of adhesion when $\theta_{AB}=0$.

In certain embodiments, reducing $\gamma_X^{LW}$, $\gamma_X^{+}$, and/or $\gamma_X^{-}$ for one of the surfaces (e.g., a wall of a pipeline) reduces the work of adhesion and thereby reduces the adhesion strength of a hydrate. Similarly, the influence of surface texture (ranging from nano to micro scales along with hierarchical nano/micro engineered surfaces) may also lead to the same effect.

FIG. 1 includes a bar graph of measured contact angles for DI water on various substrates, and a bar graph of surface energies for each of these substrates. The surface energies were calculated using vOCG analysis of measured advancing and receding contact angles of polar and nonpolar test fluids, as described in the Experiments below.

Because it may be difficult to measure surface energy parameters of a hydrate, such as solid THF hydrate, a model or probe fluid may be used to mimic the hydrate and predict the strength of adhesion forces between the hydrate and various surfaces. For example, it may be difficult to determine the surface energy parameters of a solid THF hydrate due to the evaporation of THF from the frozen hydrate surfaces prior to contact angle measurements of the test fluids used in the vOCG analysis. Further difficulties arise in selecting test fluids that are insoluble in THF and remain liquid at temperatures below the melting temperature of THF hydrate, 4.4° C. Hence, having a probe liquid that can mimic the adhesion properties of the THF hydrate is desirable for predicting the hydrate-phobicity (i.e., the ability to reduce hydrate adhesion) of a surface. For example, in studies of ice adhesion, liquid water may be used as a probe fluid. Specifically, correlations may be made between the adhesion strength of ice on a selected substrate and the work of adhesion of liquid water on that same substrate.

To apply a similar approach to predicting hydrate adhesion, ice and water were studied as a model system to provide support for a probe fluid approach and to gain insights into the selection of an appropriate probe fluid for hydrates. As discussed previously, the adhesion strength of a material to a substrate is a function of its work of adhesion to that substrate. However, for studies of ice adhesion, the work of adhesion of liquid water on a selected substrate is correlated with the adhesion strength of ice to that same substrate. It is hypothesized that the existence of this correlation is attributable to the similarity of the surface energy parameters of ice and liquid water. For water at 25° C., $\sqrt{\gamma^{LW}}$=4.67 $mJ^{1/2}$ $m^{-1}$, $\sqrt{\gamma^{+}}$=5.05 $mJ^{1/2}$ $m^{-1}$, $\sqrt{\gamma^{-}}$=5.05 $mJ^{1/2}$ $m^{-1}$, $\gamma^{total}$=72.8 mJ $m^{-2}$, and for ice at 0° C., $\sqrt{\gamma^{LW}}$=5.44 $mJ^{1/2}$ $m^{-1}$, $\sqrt{\gamma^{+}}$3.74 $mJ^{1/2}$ $m^{-1}$, $\sqrt{\gamma^{-}}$=5.29 $mJ^{1/2}$ $m^{-1}$, and $\gamma^{total}$=69.2 mJ $m^{-2}$. Consequently, the work of adhesion of liquid water to most materials is approximately equal to that of ice. This near-equality is demonstrated by calculating the work of adhesion of liquid water and that of ice to the surfaces tested in this work. Using Equation 1, the work of adhesion of ice is calculated using the surface energy parameters of ice listed above and the surface energy parameters calculated for each of the substrates using vOCG analysis (see Table 1).

TABLE 1

Surface energy parameters for various substrates.

| | Advancing surface energy data | | | | Receding surface energy data | | | |
|---|---|---|---|---|---|---|---|---|
| Substrate | $\gamma^{LW}$ [mJ/m$^2$] | $\sqrt{\gamma^{+}}$ [mJ$^{1/2}$/m] | $\sqrt{\gamma^{-}}$ [mJ$^{1/2}$/m] | $\gamma^{total}$ [mJ/m$^2$] | $\gamma^{LW}$ [mJ/m$^2$] | $\sqrt{\gamma^{+}}$ [mJ$^{1/2}$/m] | $\sqrt{\gamma^{-}}$ [mJ$^{1/2}$/m] | $\gamma^{total}$ [mJ/m$^2$] |
| 1-Butanethiol | 32 | −0.6 | 1.5 | 30 | 42 | −0.3 | 1.9 | 41 |
| 1H, 1H, 2H, 2H-Perfluorodecane-thiol | 10 | 0.5 | 0.0 | 10 | 25 | −0.3 | 1.4 | 24 |
| Methyl 3-mercapto-propionate | 44 | 0.0 | 3.7 | 44 | 44 | 0.6 | 4.9 | 50 |
| 4-Mercapto-1-butanol | 46 | 0.4 | 6.4 | 52 | N/A | N/A | N/A | N/A |
| 50/50 Butanethiol/Methyl 3-mercapto-propionate | 40 | −0.4 | 2.8 | 38 | 47 | −0.2 | 4.3 | 45 |
| 50/50 Butanethiol/4-Mercapto-1-butanol | 44 | 0.5 | 3.7 | 48 | 51 | 0.5 | 6.1 | 57 |
| Trichloro(1H, 1H, 2H, 2H perfluoro-octyl)silane | 8 | 0.8 | 0.3 | 8 | 25 | 0.1 | 2.4 | 26 |
| Octadecyltrichloro-silane | 24 | −0.3 | 0.2 | 24 | 30 | −0.4 | 1.9 | 28 |
| 80 wt. %/20 wt. % PEMA/fluorodecyl POSS | 9 | 0.1 | 0.3 | 9 | 13 | −0.2 | 1.1 | 12 |
| Clean glass | 41 | 0.7 | 7.8 | 51 | N/A | N/A | N/A | N/A |
| Bare steel | 39 | −0.3 | 3.9 | 37 | N/A | N/A | N/A | N/A |

Figure 2:
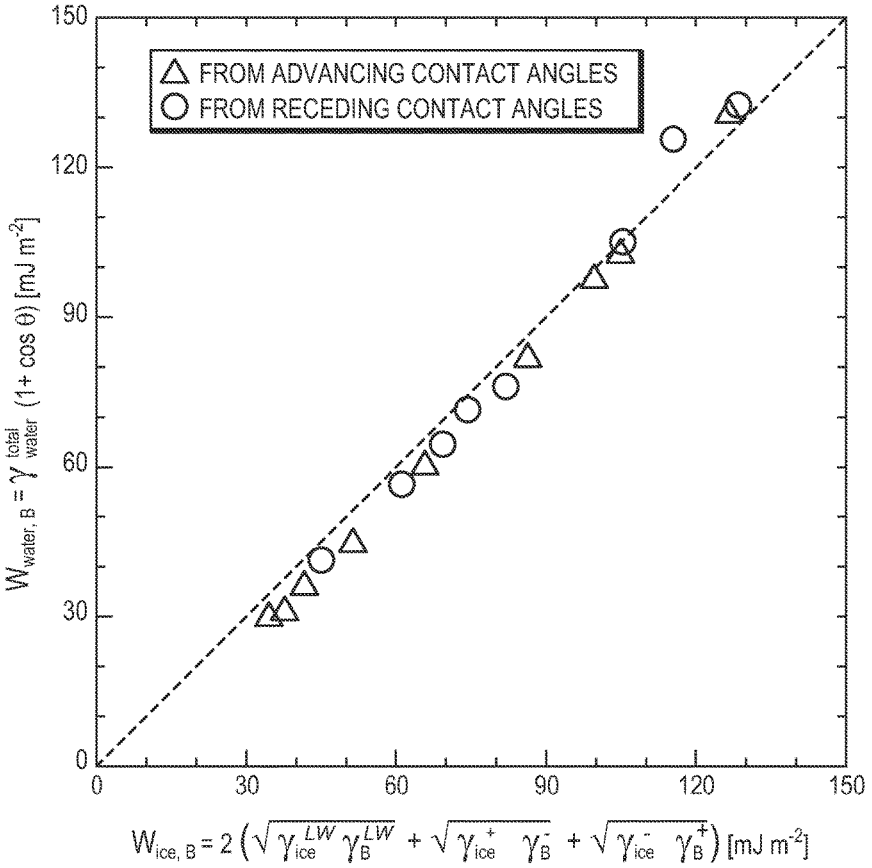
FIG. 2 is a plot of work of adhesion of liquid water versus the work of adhesion of ice, according to an illustrative embodiment of the invention.

Referring to FIG. 2, the resulting values are plotted against the work of adhesion for water, determined from its advancing and receding contact angles on the test substrates. The strong linear correlation ($R^2$=0.98) suggests that work of adhesion measurements for liquid water are a good approximation of the work of adhesion of ice. The work of adhesion of liquid water was calculated using vOCG analysis measured advancing and receding water contact angles on each test substrate. The work of adhesion of ice was calculated using the surface energy properties of ice and the advancing and receding surface energy properties of each test substrate. The similarities between the work of adhesion of liquid water and ice explain why water is an effective probe fluid for gauging ice adhesion.

According to fracture mechanics theory, adhesion strength of ice is a function of the work of adhesion of ice. Consistent with this theory and the near-equality between the works of adhesion of water and ice, the adhesion strength of ice should therefore correlate with the work of adhesion of liquid water. That is, $\tau_{ice}=f(W_{ice}^{a})\cong g(W_{water}^{a})$, where $\tau_{ice}$ the strength of ice adhesion, $W_{ice}^{a}$ is the work of adhesion of ice, and $W_{water}^{a}$ is the work of adhesion of liquid water. Different values for work of adhesion can be determined depending on the contact angle (advancing, receding, static), used in Equation 3. It has been observed that ice adhesion strength correlates most strongly with the work of adhesion calculated from receding contact angle measurements, $\gamma_{water}(1+\cos\theta_{rec})$, that is, with the practical work of adhesion for liquid water. Table 2 presents contact angles for water on various substrates. Adhesive strength of ice adhesion on these substrates is also provided.

TABLE 2

Contact angles for water on various substrates.

| Substrate | $\theta_{adv}$, water[a] | $\theta_{rec}$, water[a] | # of Ice Adhesion Tests | Fraction of Tests with Completely Adhesive Failure[b] | Average Shear Strength of Ice Adhesion at −10° C. (kPa)[c] |
|---|---|---|---|---|---|
| Bare Steel | 86.2 ± 3.3 | 25.8 ± 2.5 | 9 | 0.33 | 698 ± 112 |
| PMMA | 83.6 ± 3.6 | 60.7 ± 1.3 | 11 | 0.73 | 463 ± 65 |
| PC | 93.4 ± 1.0 | 73.9 ± 3.3 | 7 | 0.86 | 400 ± 83 |
| PBMA | 92.8 ± 2.4 | 74.6 ± 1.7 | 9 | 0.44 | 384 ± 52 |
| PDMS (Sylgard 184) | 108.9 ± 1.5 | 91.7 ± 5.1 | 9 | 1.00 | 291 ± 44 |
| PEMA | 84.6 ± 2.4 | 68.0 ± 2.5 | 9 | 0.67 | 510 ± 101 |
| 99/1 PEMA/ fluorodecyl POSS | 97.5 ± 1.2 | 67.5 ± 2.2 | 9 | 0.22 | 475 ± 50 |
| 97/3 PEMA/ fluorodecyl POSS | 105.4 ± 3.7 | 77.0 ± 4.7 | 8 | 1.00 | 367 ± 86 |
| 95/5 PEMA/ fluorodecyl POSS | 122.2 ± 2.0 | 104.0 ± 5.3 | 8 | 1.00 | 278 ± 93 |
| 90/10 PEMA/ fluorodecyl POSS | 122.6 ± 2.1 | 107.6 ± 6.9 | 12 | 0.92 | 247 ± 45 |
| 80/20 PEMA/ fluorodecyl POSS | 123.8 ± 1.2 | 118.2 ± 2.4 | 7 | 1.00 | 165 ± 27 |
| 70/30 PEMA/ fluorodecyl POSS | 124.2 ± 0.9 | 116.4 ± 2.9 | 9 | 1.00 | 166 ± 44 |
| 50/50 PEMA/ fluorodecyl POSS | 125.0 ± 1.7 | 114.1 ± 2.4 | 8 | 1.00 | 185 ± 57 |
| Tecnoflon | 118.3 ± 1.4 | 73.7 ± 2.1 | 17 | 0.76 | 389 ± 63 |
| 99/1 Tecnoflon/ fluorodecyl POSS | 125.7 ± 1.9 | 79.2 ± 3.4 | 13 | 0.92 | 392 ± 88 |
| 97/3 Tecnoflon/ fluorodecyl POSS | 127.0 ± 1.7 | 87.7 ± 4.8 | 11 | 0.82 | 412 ± 64 |
| 95/5 Tecnoflon/ fluorodecyl POSS | 126.6 ± 1.2 | 92.9 ± 4.3 | 15 | 1.00 | 328 ± 97 |
| 90/10 Tecnoflon/ fluorodecyl POSS | 126.6 ± 0.8 | 98.0 ± 5.3 | 9 | 1.00 | 345 ± 104 |
| 80/20 Tecnoflon/ fluorodecyl POSS | 126.0 ± 0.9 | 103.7 ± 4.3 | 11 | 1.00 | 313 ± 70 |
| 70/30 Tecnoflon/ fluorodecyl POSS | 125.2 ± 0.8 | 110.0 ± 3.1 | 9 | 1.00 | 205 ± 40 |
| 50/50 Tecnoflon/ fluorodecyl POSS | 128.3 ± 1.1 | 108.7 ± 3.4 | 8 | 1.00 | 265 ± 42 |
| Fluorodecyl POSS | 137.6 ± 4.8 | 110.0 ± 3.8 | 15 | 1.00 | 250 ± 54 |

Figure 3:
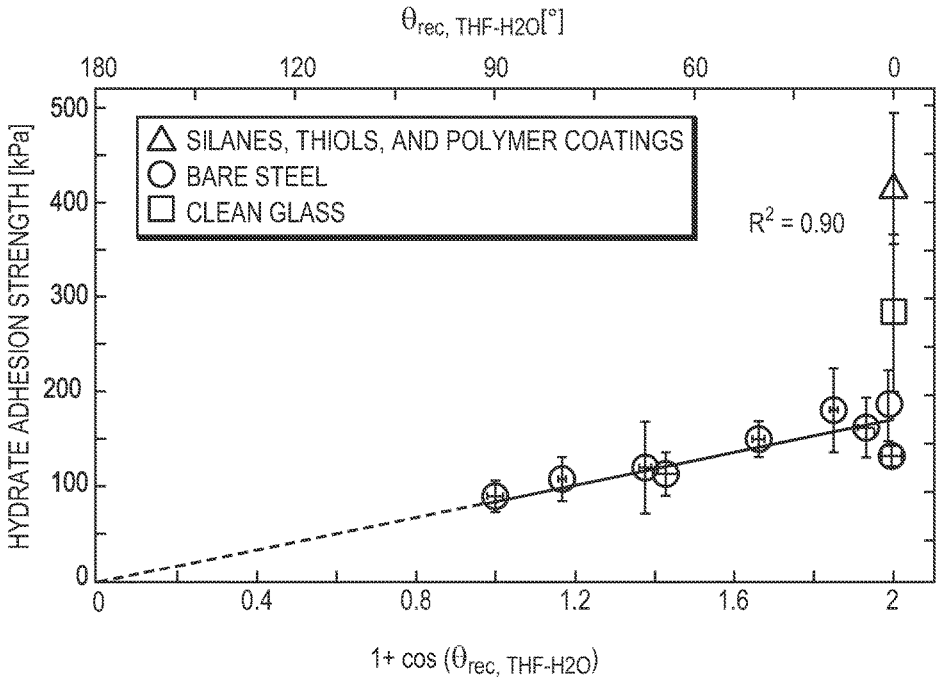
FIG. 3 is a plot of hydrate adhesion strength versus the practical work of adhesion of a 19.1 wt. % THF in water solution, according to an illustrative embodiment of the invention.
Figure 4:
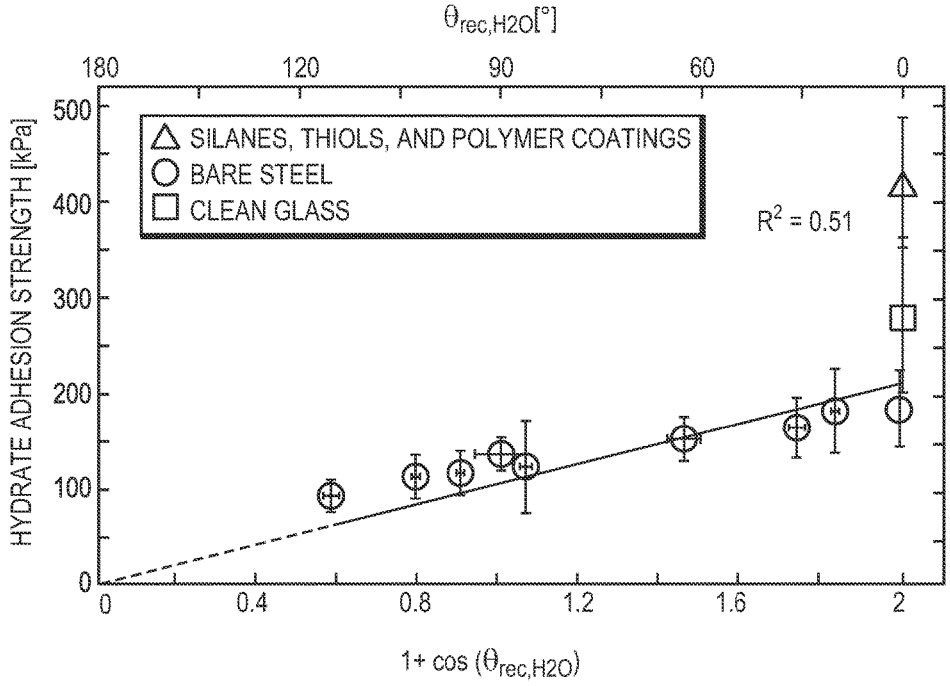
FIG. 4 is a plot of hydrate adhesion strength versus the practical work of adhesion of liquid water, according to an illustrative embodiment of the invention.

In another embodiment, a probe fluid is selected to be used in approximating the work of adhesion of solid hydrate to various substrates. For example, for the solid THF hydrate, the 19.1 wt. % THF in water solution used to form THF hydrate is a good choice. FIG. 3 is a plot of THF hydrate adhesion strength versus the normalized practical work of adhesion, $1+\cos\theta_{rec}$, of the 19.1 wt. % THF in water solution. A linear fit through the origin shows an excellent correlation ($R^2=0.90$) consistent with the fact that hydrate adhesion strength must approach zero as the work of adhesion of a probe fluid approaches zero (supplementary materials). In comparison, referring to FIG. 4, if DI water is used as a probe fluid, a linear correlation passing through the origin is relatively poor ($R^2=0.51$).

The surface energy properties of the 19.1 wt. % THF in water solution were estimated using a "reverse vOCG analysis" of its advancing and receding contact angles on each of the test surfaces (see supplementary material). The resulting surface energy parameters are $\sqrt{\gamma^{LW}}=4.3\ mJ^{1/2}\ m^{-1}$, $\sqrt{\gamma^{+}}=1.6\ mJ^{1/2}\ m^{-1}$, $\sqrt{\gamma^{-}}=9.1\ mJ^{1/2}\ m^{-1}$, and $\gamma^{total}=47\ mJ\ m^{-2}$. The polar terms are significantly different from the aforementioned polar surface energy parameters of water, resulting in different work of adhesion measurements on the test surfaces. The correlation in FIG. 3 exists because the polar and van der Waals surface energy properties of the 19.1 wt. % THF in water solution reflect those of THF hydrate, just as liquid water reflects the surface energy properties of ice. Thus, the practical work of adhesion of 19.1 wt. % THF in water solution can be used to estimate the adhesion strength of THF hydrate. The lowest hydrate adhesion strength was observed on the 80%/20% PEMA/fluorodecyl POSS treated steel disc, which exhibited the highest receding contact angle of the THF-water solution (90°). The positive slope and monotonic behavior of the data plotted in FIG. 3 suggest that lower hydrate adhesion could be achieved on surfaces with lower practical work of adhesion to the THF-water probe fluid. This can be accomplished by minimizing the polar and nonpolar surface energy parameters of the coating.

Referring again to FIG. 3, the high surface energies of clean glass and steel resulted in their complete wetting by the THF-water solution ($\theta_{rec}=0$). For these surfaces the normalized practical work of adhesion may be greater than two (1+cos(0)). For this reason, these points were excluded from the correlation, while presented on the plot to demonstrate their much greater adhesion to hydrates compared to the treated substrates. More than four-fold reduction in adhesion strength was measured on low-surface energy coatings compared to bare steel.

Figure 5:
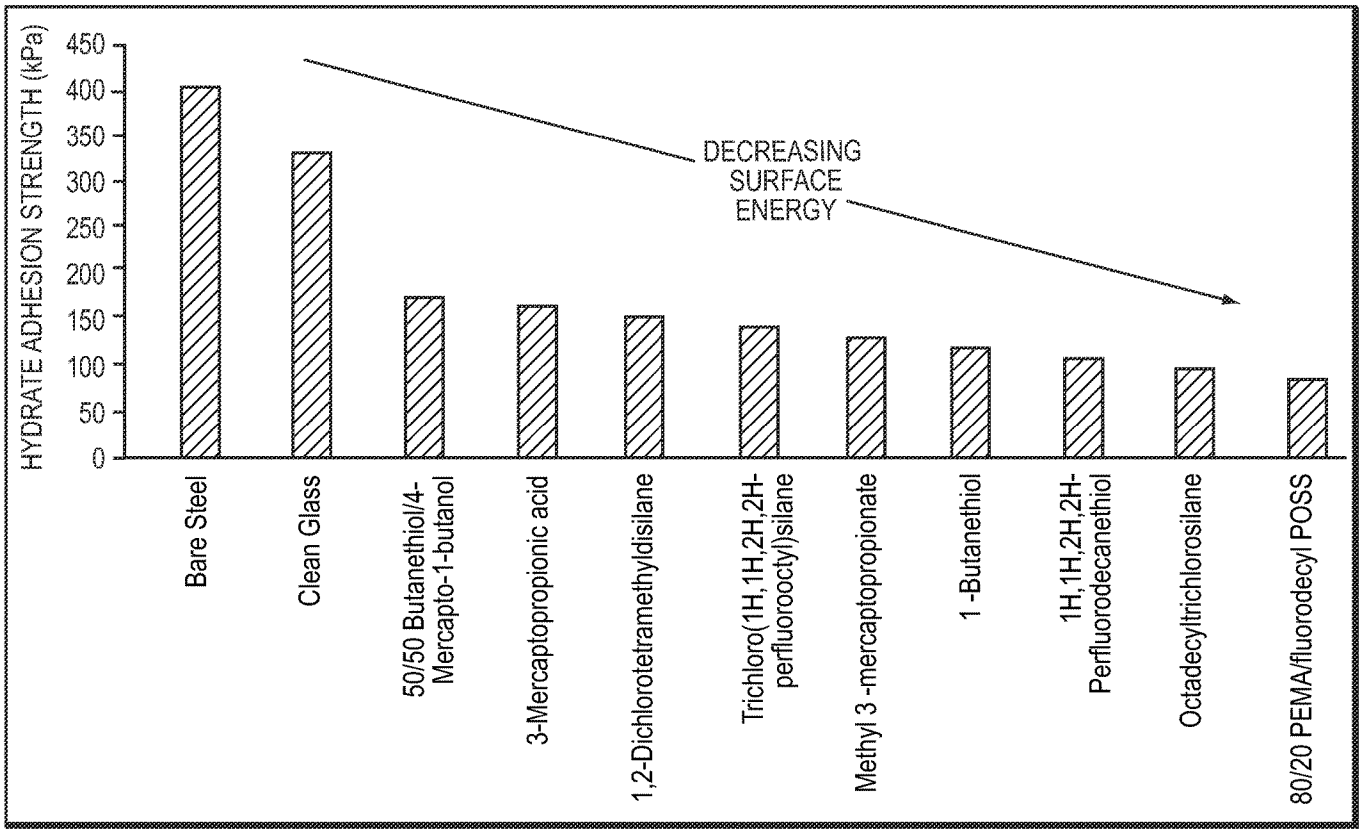
FIG. 5 is a plot of measured hydrate adhesion strength for various substrates, according to an illustrative embodiment of the invention.

FIG. 5 is a plot of measured hydrate adhesion strength for various substrates. As indicated, the adhesion strength generally decreased with decreasing surface energy of the substrates.

Referring again to Table 1 and FIG. 3, the lowest hydrate adhesion strength was observed on the 80%/20% PEMA/fluorodecyl POSS treated steel disc, which exhibited the highest receding contact angle of the THF-water solution (90°). The positive slope and monotonic behavior of the data plotted in FIG. 3 suggest that lower hydrate adhesion could be achieved on surfaces with lower practical work of adhesion, compared to the 19.1 wt. % THF in water solution. A lower practical work of adhesion may be accomplished by tailoring the surface chemistry to minimize the polar and van der Waals interactions that govern Equation 1. Although the PEMA/POSS blend has extremely low van der Waals and polar parameters of surface energy, it is possible for the Lewis acid parameter of the surface energy, $\sqrt{\gamma_B^+}$, to be negative, as is the case for some of the surfaces in Table 1. The significance of this result is that the acidic character in a surface leads to a negative contribution to its surface energy (since $\gamma_B^{total}=\gamma_B^{LW}+2\sqrt{\gamma_B^+}\sqrt{\gamma_B^-}$) and a negative (repulsive) contribution to its work of adhesion with other polar materials ($2\sqrt{\gamma_B^+}\sqrt{\gamma_B^-}<0$). Thus, in one embodiment, further reductions in adhesion strength are possible with a negative Lewis acid parameter of the surface energy.

Negative values of $\sqrt{\gamma^+}$ have been observed on the surfaces of thiols and silanes that terminate in hydrocarbon chains (1-Butanethiol, 50/50 Butanethiol/Methyl 3-mercaptopropionate, Octadecyltrichlorosilane, in Table 1). When negative values of $\sqrt{\gamma^+}$ for the solid surface are multiplied by positive values of $\sqrt{\gamma^-}$ of the hydrate (or hydrate-mimicking probe fluid), they lend a negative contribution to the work of adhesion (see Equation 1). If $\sqrt{\gamma^-}$ of the substrate is low enough, there can be an overall "non-van der Waals" repulsion captured in the Lewis-acid and Lewis-base terms of the work of adhesion. Such negative values of $\sqrt{\gamma^+}$ (and consequent repulsive forces with other materials such as a hydrate) may, for example, exist on a surface made up of an array of positive dipoles oriented outward from the surface. In one embodiment, this is consistent with the observation that surfaces terminating in hydrocarbon chains have negative $\sqrt{\gamma^+}$. The positive dipoles on the hydrogen in the hydrocarbon chains have an electrostatic repulsion with the positive dipoles of water that may be stronger than their attraction to the negative dipoles of water. A similar effect may be observed in other materials that have a permanent positive charge, or that can be given a temporary or permanent positive. In one embodiment, pyroelectric materials are utilized, which can provide a positive surface charge upon heating or cooling.

Figure 6:
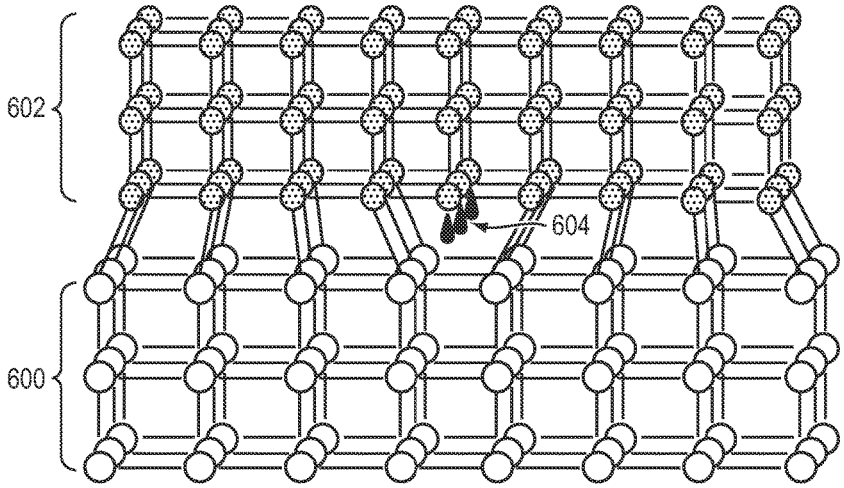
FIG. 6 is a schematic view of a lattice mismatch between a hydrate and a substrate, according to an illustrative embodiment of the invention.
Figure 7:
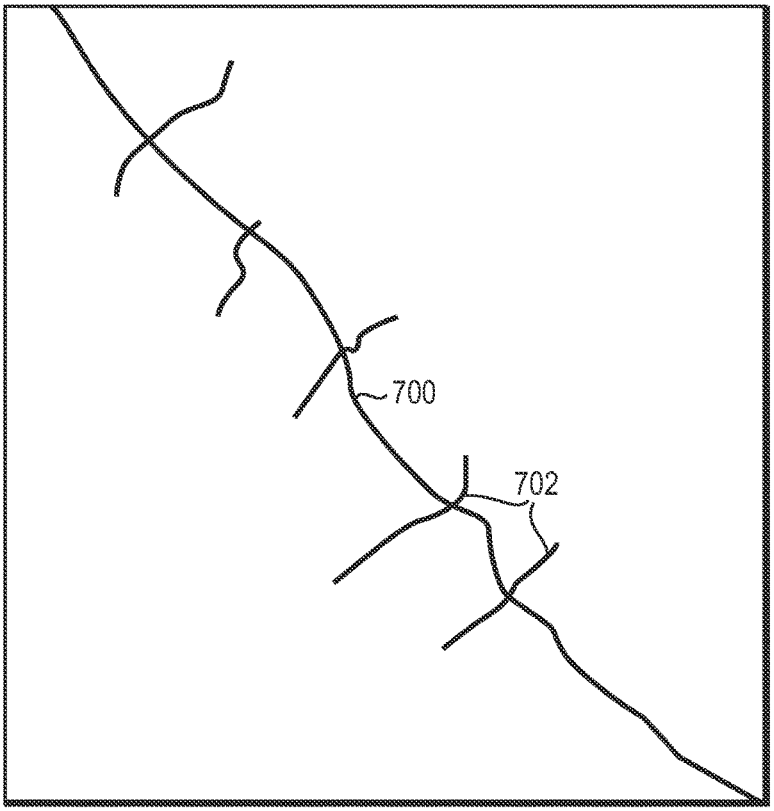
FIG. 7 is a schematic drawing of an interface between a hydrate and a substrate, according to an illustrative embodiment of the invention.

In another embodiment, the adhesion strength of a hydrate is reduced by engineering a lattice mismatch between the hydrate and the surface. Specifically, referring to FIG. 6, the lattice constant of the surface material 600 is engineered or selected to be different from the lattice constant of the hydrate material 602. As depicted, the lattice mismatch results in a dangling bond 604 at an interface between the materials 600, 602. By increasing the lattice mismatch (i.e., the mismatch between the lattice constants of the two materials 600, 602), defects may be created at the hydrate-surface interface, thereby reducing the strength of the adhesive bond. FIG. 7 is a schematic drawing of a hydrate-surface interface 700 showing defects or cracks 702 at the interface.

In one embodiment, the influence of the temperature and the guest molecule (e.g., methane) on the lattice parameter is small. Lattice structure, however, is important (e.g., SI, SII, SH). Methane hydrate is an SI (space group Pm3n) type hydrate, and its lattice parameter was measured at a=11.77 Å at 100K. At higher temperatures, the lattice parameter of the methane hydrate has not been measured. However, because lattice parameters of hydrates have very little dependence on the guest molecule, the lattice parameter of ethylene oxide hydrate, another SI hydrate, may be used to estimate the lattice parameter of methane hydrate. The lattice parameter of ethylene oxide is 12.03 Å at −25° C. Thus, surfaces may be designed based on the lattice parameter of methane hydrate being around 12 Å in deep sea pipelines.

In certain embodiments, the lattice spacing to be considered is $$\varepsilon=(n*a_s-a_h)/a_h \tag{4}$$

where ε is the lattice mismatch, a_s is the substrate lattice parameter, a_h is the hydrate lattice parameter, and n is the multiple of the lattice parameter of the substrate that is closest to that of the methane hydrate. For a lattice parameter of methane hydrate around 12 Å, materials with lattice parameters around 2, 3, 4, 6, or 12 are of interest. For reference, while methane hydrate is cubic, with only 1 lattice parameter (12 Å), the substrate may have more than one lattice parameter. The hydrate will undergo nucleation and grow on exposed crystal planes of the substrate having the least mismatch with the hydrate.

In certain embodiments, the lattice mismatch results in a tensile lattice strain of between 0.001 (~0) and 0.12. In one embodiment, the lattice parameter for the substrate is from about 2 to about 2.24, from 3 to about 3.36, from 4 to about 4.48, or from 6 to about 6.72. In another embodiment, the desired lattice mismatch with methane hydrate is achieved using a substrate that includes one or more of the following materials: $Br_2Ni$, Cronstedtite, Silicon carbide (SiC), Iowaite, Brucite, $Fe(OH)_2$ ("white-rust"), Zaccagnaite, Moissanite (SiC), $CaIrO_3$, Dyscrasite, Zincite, Potarite, Thungsten, Pyrochroite, Co(OD), $CaPtO_3$, $B_2Mo$, Palladinite, Scandium, Lithium, $Ni_7$—$S_6$, Molybdenite, Theophrastite, Ag0.6$NbS_2$, cesium, silicon, $TaS_2$, Co $H_2O_2$, Koenenite, Hafnium, Magnesium, Scandium, Zirconium, Molybdenum, Nobium, Tantalum, titanium, vanadium, phosphorus, manganese-delta, AlN, GaN, NbN, TaN, TiS, VP, VS, MoB, WB, $Ti_2CS$, TaP, $Li_2O_2$, Amakinite, Antimony, $CuO_2Rh$, $Ti_3SiC_2$, $CaFe_3O_5$, $CaFe_4O_6$, $CaFe_5O_7$, $LiFeSnO_4$Li0.7Fe0.375Sn0.54$O_2$, Tungstenite, Jamborite (NiOH), $Nb_2$, Theophrastite (NiO), Montroseite (Fe-$VOHO_2$), Periclase (MgO), Heazlewoodite (NiS), Stishovite (SiO), Stibarsen, vulcanite, Magnesite, Diaspore, Magnesiowustite (MgFeO), $SiO_2$, $GeO_2$, and FeB.

Figure 8:
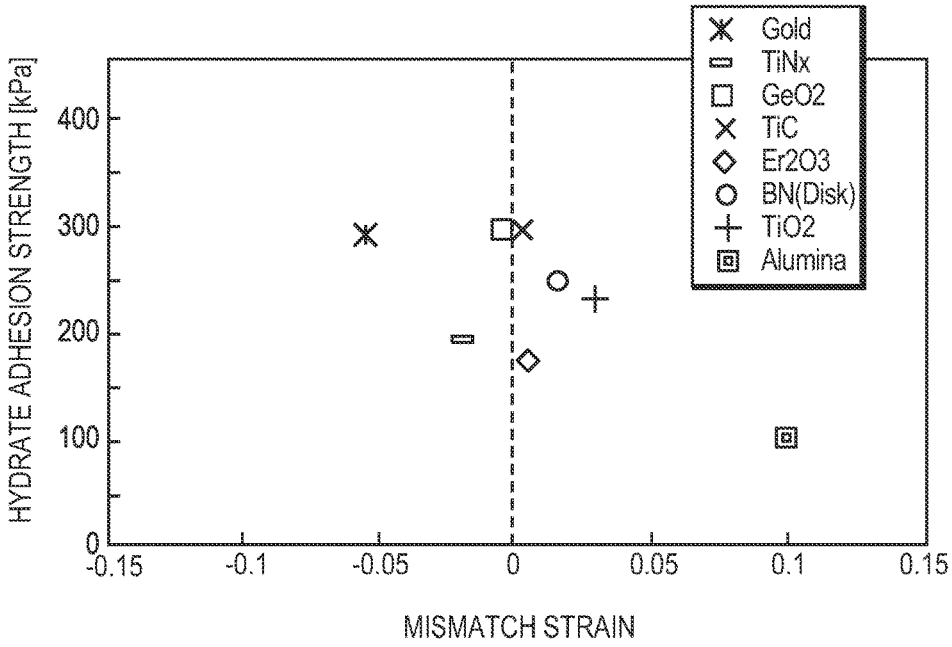
FIG. 8 is a plot of hydrate adhesion strength versus lattice mismatch strain, according to an illustrative embodiment of the invention.

FIG. 8 is a plot of measured hydrate adhesion strength versus mismatch strain (i.e., strain caused by lattice mismatch), on various substrates. The TiNx substrate was prepared via reactive sputtering of titanium and nitrogen, onto VWR glass slides. The boron nitride (BN) substrate was prepared from high purity hexagonal BN (available from McMaster-Carr of Atlanta, Ga.). A 1 mm thick BN sheet was polished using 1500 grit silicon carbide polishing paper. The $GeO_2$ and $Er_2O_3$ substrates were produced by sputtering onto VWR glass slides. The $TiO_2$ surface was fabricated by sputtering titanium, which oxidizes in ambient air to form $TiO_2$. Alumina was formed by the oxidation of polished aluminum in ambient air. The gold substrate was an evaporated gold-coated glass slides having 100 nm of gold with a 5 nm adhesion layer of titanium (available from Evaporated Metal Films of Ithaca, N.Y.).

When water-wet gas expands rapidly through a valve, orifice or other restriction, hydrates may form due to rapid gas cooling caused by adiabatic (joule-thomson) expansion. This commonly occurs in fuel gas lines or instrument gas lines. In certain embodiments, to prevent the accumulation of hydrates in a pipeline, the pipeline includes a hydrate-phobic surface or coating. For example, the surface may be located just beyond a restriction, such as a vale or a choke valve. In one embodiment, the surface is located within the first three meters after a valve. The surfaces may also be located at one or more of the following locations: in orifices or other restrictions; within fuel gas lines or instrument gas lines (e.g., after valves within fuel gas lines or valves within instrument gas lines); downstream of flow-line water accumulations, such as a flow-line low spot or at a riser, or where there is a change in flow geometry (e.g., a bend or pipeline dip along an ocean floor depression); at a nucleation site (e.g., weld slag, or pipe flanges); in the manifold; and on sensors embedded within the pipeline.

EXPERIMENTAL EXAMPLES (INCLUDING CONSTRUCTIVE EXAMPLES)

For the hydrate adhesion strength measurements, tetrahydrofuran (THF) hydrate was used as a model system because THF is completely miscible in water and forms hydrate at atmospheric pressure and temperatures below 4.4° C. for a solution of 19.1% THF (by weight) in water. THF hydrate adhesion was tested using a custom-built adhesion testing apparatus housed in a glove box containing a nitrogen environment. A solution of 19.1 wt. % THF in DI water was poured into glass cuvettes and frozen to the test substrates. The liquid columns were frozen for 2 hours at −15° C. to yield an array of hydrate columns encased in cuvettes and adhered to the test substrates. The substrate temperature was monitored using a thermocouple attached to the top of one of the substrates. To minimize frost formation on the test substrates and apparatus, the relative humidity was kept below 5%.

The force required to detach each hydrate column from its test substrate was measured by driving a 12 mm wide wedge-shaped probe head of a force transducer (model ZP-44, available from Amada, Inc. of Northbrook, Ill.) into contact with the side of the hydrate-filled cuvette at a constant velocity of 1 mm $s^{-1}$ and continuing to drive the probe forward until the hydrate broke free from the substrate. Hydrate adhesion strength was obtained by dividing the measured maximum force by the cross-sectional area (1 $cm^2$) of the hydrate-substrate interface established by the cuvette size. Fracture was observed to be predominantly adhesive, that is, no hydrate shards remained on the surfaces after adhesion testing.

The mechanism of hydrate formation was observed as the THF-water solution was subcooled during the hydrate freezing process. Results indicate that the hydrate formed on the solid surface (e.g., the cuvette surface), which was at the lowest temperature, and grew into the solution, confirming that heterogeneous nucleation occurred on the surface. The hydrate continued to grow until the columns of solution were completely solidified.

A library of test surfaces with varying chemistries was established in order to elucidate the influence of surface properties, such as wettability and surface energy, on adhesion strength. These surfaces, ranging from hydrophilic to hydrophobic, include thiolated gold, silane-treated glass, and a blend of 80 wt. %/wt. 20% poly(ethyl methacrylate) (PEMA)/fluorodecyl polyhedral oligomeric silsesquioxane (fluorodecyl POSS) spin coated onto steel. Surface energies of each of the test substrates were calculated using van Oss-Chaudhury-Good (vOCG) analysis from measured advancing and receding contact angles of up to five test fluids. Advancing and receding contact angles of DI water and surface energies calculated from advancing and receding contact angles of the test fluids are provided in FIG. 1, above, for each of the surfaces tested.

Referring to FIG. 1, advancing contact angles range from 35° to 125° and receding contact angles range from 5° to 115°. Advancing surface energies range from 8 mJ $m^{-2}$ to 50 mJ $m^{-2}$ and receding surface energies range from 12 mJ $m^{-2}$ to 57 mJ $m^{-2}$. Receding contact angles of several of the test fluids on 4-Mercapto-1-butanol were zero, thus its receding surface energy could not be determined precisely, and the plotted value represents its minimum receding surface energy.

Contact angles of four polar fluids: DI water (18 MΩ-cm, Millipore), ethylene glycol (Alfa Aesar), formamide (Alfa Aesar), and a 19.1 wt. % mixture of THF (Alfa Aesar) in DI water, and two nonpolar fluids: 1-bromonaphthalene (Alfa Aesar) and diiodomethane (Alfa Aesar), were measured on the test surfaces using a Ramé-Hart Model 500 Advanced Goniometer/Tensiometer. Advancing ($\theta_{adv}$) and receding ($\theta_{rec}$) angles were taken as an average of at least 8 measurements. 5 μl droplets were deposited at a volume addition/subtraction rate of 0.2 μl $s^{-1}$, yielding contact line velocities less than 1 mm $min^{-1}$. The resulting capillary numbers ($Ca=\mu V/\gamma$) were less than $10^{-5}$ for all fluids tested, ensuring that the measured dynamic contact angles were essentially the same as contact angles obtained immediately after the contact line comes to a stop. Advancing and receding surface energies were computed using vOCG analysis of the gathered advancing and receding contact angle data.

The Lifshitz-van der Waals, Lewis acid, and Lewis base contributions, as well as the total solid phase surface energy ($\gamma^{LW}$, $\sqrt{\gamma^+}$, $\sqrt{\gamma^-}$, and $\gamma^{total}$ respectively) are provided in Table 1, above. Different values are obtained depending on whether advancing or receding values of test fluids are used in the vOCG analysis. Some receding surface energies could not be determined because non-zero receding contact angles of at least one nonpolar and two polar probe fluids were not always attained. For example, receding surface energies of steel, glass, and 4-mercapto-1-butanol could not be determined because non-zero receding contact angles of at least one nonpolar and two polar test fluids were not attained on these surfaces. The error in these surface energy data is on the order of 15%. The surface energy parameters in Table 1 were calculated from advancing and receding contact angles of DI water, ethylene glycol, formamide, 1-bromonaphthalene, and diiodomethane using vOCG analysis, where $\gamma^{total}=\gamma^{LW}+2\sqrt{\gamma^+}\sqrt{\gamma^-}$.

The surface tension, and therefore the contact angle, of the THF-water solution varied with time due to evaporation of THF from the solution. The variation of surface tension with time was measured using the pendant drop method. Based on these measurements, care was taken to measure advancing and receding contact angles of the THF-water solution before significant evaporation of THF from the solution could occur.

Surface texture plays an important role in adhesion and can often result in interlocking of the adhering materials, increasing adhesion strength. This has been demonstrated in studies of ice adhesion, in which a linear increase in adhesion strength may be observed with the Wenzel roughness, that is, the total surface area divided by the occluded area. For the purpose of these experiments, the goal was to investigate the effects of surface chemistry alone, and therefore efforts were focused on smooth surfaces. Surface profilometry was conducted to verify the smoothness of the test surfaces. A Tencor P-12 profilometer with a 2 μm radius stylus and a Zygo interferometer were used to measure the roughness of the steel discs and the 80%/20% PEMA/fluorodecyl POSS coated steel discs. Atomic force microscopy (AFM) was carried out on glass, gold, and some representative silanes and thiols using a VeecoDimension 3100 scanning probe microscope operating in the tapping mode. The Wenzel roughness was $r<1.06$ for all surfaces tested.

Reduction of Hydrate Adhesion to a Surface Disposed with Preferred Nucleation Sites.

Without wishing to be bound by a particular theory, it is believed that the rate of heterogeneous nucleation on a smooth surface is a function of substrate temperature, pressure, and the surface energies of the interfaces between the hydrate, vapor, and solid phases. This nucleation rate decreases with the surface energy of the substrate, and with increasing substrate temperature. The result of these dependencies is that for a given substrate surface energy, a certain degree of subcooling, or overpressure, beyond the hydrate dissociation temperature and pressure is required before any macroscopically detectable nucleation occurs. Thus for a surface comprised of two surface energies, any observable nucleation (e.g. of hydrate, frost, or condensate) will occur exclusively, or at least preferentially, on the high surface energy patches. This can effectively control the preferred nucleation sites of water in condensation experiments. Similarly, high surface energy sub-micron particles (e.g. metals, ceramics, and cermets) may be deposited onto a surface of lower surface energy (e.g. using solution deposition methods, followed by sintering, figure, or inkjet printing). These dispersed particles, or dispersed piles of particles, may then act as high surface energy nucleation sites for the hydrate.

Hydrate nucleation can similarly be inhibited on low surface energy materials. To demonstrate this, we measured the temperature at which nucleation of THF hydrate is macroscopically detectable, T_crit, on a fluorosilane treated glass slide (low surface energy/hydrophobic) and a clean glass (high surface energy/hydrophilic) slide filled two glass cuvettes with a mixture of THF-water, and flipped them over onto substrates of different surface energies using the protocol previously described. A 19.1 wt. % solution of THF in DI water was poured into glass cuvettes, and flipped over onto the glass and fluorosilane treated glass substrates, resulting in contact of the THF-water solution with the substrate. These substrates were then placed on a Peltier plate, and frozen at a rate of 2° C. per minute. The temperature was monitored using a thermocouple that had been frozen to the surface of a glass substrate mounted next to the test substrates. A high definition camera was used to record the hydrate formation in each of cuvettes, and temperature at which incipient hydrate formation was detected, T_crit, was recorded for each substrate. For glass hydrate formation was observed at −1.2° C., whereas on fluorosilane hydrate formation was observed at −8° C. high surface energy materials.

Without wishing to be bound by any particular theory, it is believed that adhesion will be reduced on surface comprising discrete nucleation sites (e.g., high surface energy sites or high-surface energy nanoparticles sites) because hydrate crystals grow outward from the discrete nucleation points. These hydrate freezing fronts collide, creating a defective interface between the bulk hydrate and the substrate. Furthermore, the adhesion strength per unit area is significantly higher for hydrate that grows directly from a surface than for hydrate that is brought into contact with a surface. Thus, a hydrate will only have high adhesion strength at the high surface energy points on which it nucleated, which may comprise a small fraction of the total surface area. Whereas on a smooth surface, hydrate can grow from any point on the surface, resulting in greater adhesion strength. To demonstrate this effect, hydrate adhesion strength was measured for a hydrate that had grown directly from a surface and compared to a hydrate that grew from high surface energy particles within the solution. We demonstrate a 50% reduction in adhesion when a hydrate grows from particles to a substrate rather than directly on a substrate.

Two surfaces were treated with fluorosilane in separate cuvettes. One cuvette was filled with a mixture of 19.1 wt. % THF in water solution mixed with silica particles of 30 nm diameter, such that the suspended silica made up 10% of the total solution weight. The solution was then sonicated to break up any silica that may have agglomerated. The other cuvette did not contain nanoparticles. It was found that hydrate adhesion was reduced by 50% due to the presence of the nanoparticles within the solution. It is believed that this is because nucleation preferentially occurs on the nanoparticles rather than the substrate, and the resulting hydrate adhesion on the surface is lower due to capillary bridging.

Figure 9A:
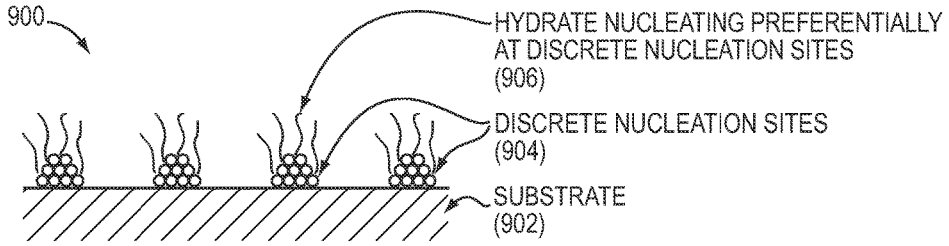
FIG. 9A is a schematic drawing of a hydrate-phobic surface (surface with inhibited hydrate adhesion thereto) with discrete preferential hydrate nucleation sites, according to an illustrative embodiment of the invention.

FIG. 9A is a schematic drawing 900 of a substrate 902 with hydrate-phobic surface (surface with inhibited hydrate adhesion thereto) with discrete preferential hydrate nucleation sites 904. Hydrate 906 preferentially nucleates and grows at the discrete nucleation sites, resulting in reduced hydrate adhesion to the surface.

Figure 9B:
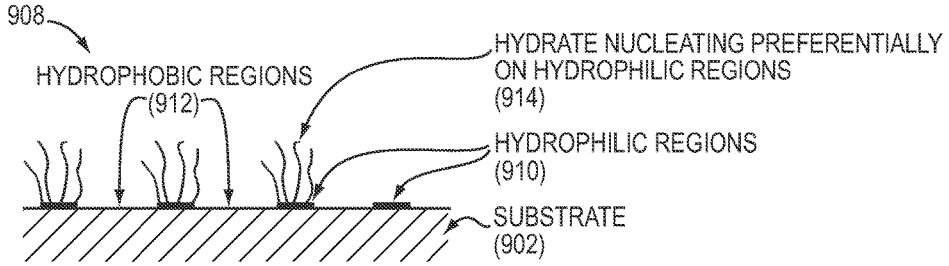
FIG. 9B is a schematic drawing of a hydrate-phobic surface patterned with hydrophobic and hydrophilic regions, according to an illustrative embodiment of the invention.

FIG. 9B is a schematic drawing 908 of the substrate 902 with a hydrate-phobic surface patterned with hydrophobic regions (912) and hydrophilic regions (910). Hydrate 914 preferentially nucleates and grows on the hydrophilic regions, resulting in reduced hydrate adhesion to the surface.

Figure 9C:
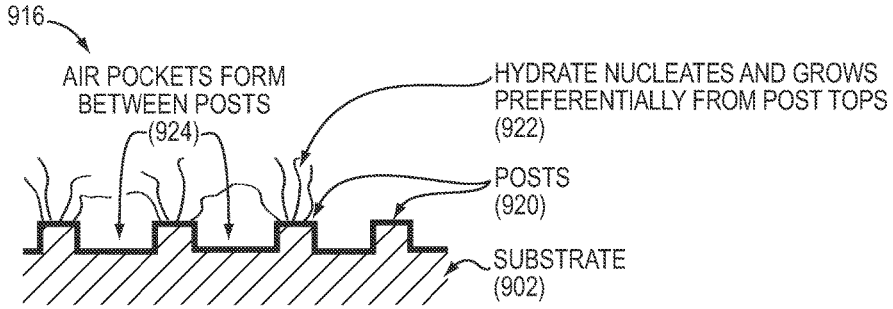
FIG. 9C is a schematic drawing of a hydrate-phobic surface patterned with posts deposited thereupon, the tops of which serve as preferential hydrate nucleation sites, according to an illustrative embodiment of the invention.

FIG. 9C is a schematic drawing 916 of the substrate 902 with a hydrate-phobic surface patterned with posts 920, the tops of which serve as preferential hydrate nucleation sites. Hydrate 922 preferentially nucleates and grows from the tops of the posts 920, forming air pockets 924 between the posts 920, resulting in reduced hydrate adhesion to the surface.

EQUIVALENTS

While the invention has been particularly shown and described with reference to specific preferred embodiments, it should be understood by those skilled in the art that various changes in form and detail may be made therein without departing from the spirit and scope of the invention as defined by the appended claims.

What is claimed is:

1. An article for use in a deep sea oil and/or gas recovery operation, the article comprising a surface having receding contact angle of water, $\theta_{rec}$ of no less than 100°, wherein the article is a fuel gas line or instrument gas line and wherein the surface is a hydrate-phobic surface that inhibits hydrate adhesion thereupon in the presence of oil and/or gas.

2. The article of claim 1, wherein the article is an underwater pipeline.

3. The article of claim 1, wherein the surface comprises a fluoropolymer.

4. The article of claim 3, wherein the fluoropolymer is a silsesquioxane.

5. The article of claim 3, wherein the fluoropolymer is a member selected from the group consisting of tetrafluoroethylene (ETFE), fluorinated ethylene-propylene copolymer (FEP), polyvinylidene fluoride (PVDF), perfluoroalkoxytetrafluoroethylene copolymer (PFA), polytetrafluoroethylene (PTFE), tetrafluoroethylene perfluoromethylvinylether copolymer (MFA), ethylene-chlorotrifluoroethylene copolymer (ECTFE), ethylene-tetrafluoroethylene copolymer (ETFE), perfluoropolyether, and Tecnoflon.

6. The article of claim 1, wherein the surface has receding contact angle of water, $\theta_{rec}$, of no less than 110°.

7. An article for use in a deep sea oil and/or gas recovery operation, the article having a surface comprising fluorodecyl polyhedral oligomeric silsesquioxane, the surface having receding contact angle of water, $\theta_{rec}$ of no less than 100°, wherein the article is a fuel gas line or instrument gas line and wherein the surface is a hydrate-phobic surface that inhibits hydrate adhesion thereupon in the presence of oil and/or gas.

8. The article of claim 7, wherein the surface is a coating.

9. The article of claim 7, wherein the hydrate-phobic surface is located on an interior wall of an oil and/or gas pipeline extending a distance from a valve in a direction of flow through the pipeline.

10. The article of claim 9, wherein the hydrate-phobic surface extends at least three meters from a valve in the direction of flow.

11. The article of claim 9, wherein the valve is located at a Christmas tree of an offshore system.

12. The article of claim 7, wherein the hydrate-phobic surface is located on an interior wall of a pipeline: (i) extending a first distance along and/or beyond a restriction in a direction of flow through the pipeline; (ii) extending along a fuel gas line in a direction of flow through the pipeline; (iii) extending along an instrument gas line in a direction of flow through the pipeline; (iv) extending a second distance along and/or beyond a valve within a fuel gas line in a direction of flow; (v) a third distance along and/or beyond a valve within an instrument gas line in a direction of flow; (vi) extending a fourth distance along and/or beyond a location of flow-line water accumulation in a direction of flow through the pipeline; (vii) extending a fifth distance along and/or beyond a flow-line low spot in a direction of flow through the pipeline; (viii) extending a sixth distance along and/or beyond a riser in a direction of flow through the pipeline; (ix) extending a seventh distance along and/or beyond a bend in the pipeline in a direction of flow through the pipeline; and/or (x) extending an eighth distance along and/or beyond a change in topography of ocean flow traversed by the pipeline.

13. The article of claim 12, wherein one or more of the first through eighth distance is at least three meters.

14. The article of claim 7, wherein the hydrate-phobic surface is located on or about a manifold of an offshore system.

15. The article of claim 7, wherein the hydrate-phobic surface is located on or about a sensor embedded in a pipeline of an offshore system.

* * * * *